US010581189B2

(12) United States Patent
Qiao et al.

(10) Patent No.: US 10,581,189 B2
(45) Date of Patent: Mar. 3, 2020

(54) CABLE-TO-BOARD CONNECTOR

(71) Applicant: 3M INNOVATIVE PROPERTIES COMPANY, St. Paul, MN (US)

(72) Inventors: YunLong Qiao, Singapore (SG); Saujit Bandhu, Singapore (SG); Chin Hua Lim, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/648,511

(22) PCT Filed: Dec. 6, 2013

(86) PCT No.: PCT/US2013/073458
§ 371 (c)(1),
(2) Date: May 29, 2015

(87) PCT Pub. No.: WO2014/099405
PCT Pub. Date: Jun. 26, 2014

(65) Prior Publication Data

US 2015/0311612 A1 Oct. 29, 2015

Related U.S. Application Data

(60) Provisional application No. 61/739,463, filed on Dec. 19, 2012.

(51) Int. Cl.
*H01R 13/58* (2006.01)
*H01R 12/75* (2011.01)
(Continued)

(52) U.S. Cl.
CPC ..... *H01R 12/75* (2013.01); *H01R 12/716* (2013.01); *H01R 12/79* (2013.01); *H01R 13/6581* (2013.01); *H01R 31/06* (2013.01)

(58) Field of Classification Search
CPC ..... H01R 12/716; H01R 12/75; H01R 12/79; H01R 13/6581; H01R 31/06
(Continued)

(56) References Cited

U.S. PATENT DOCUMENTS 5,201,664 A * 4/1993 Korsunsky ..... H01R 12/716 439/83
6,273,753 B1 8/2001 Ko
(Continued)

FOREIGN PATENT DOCUMENTS

CN 2588592 Y 11/2003
WO WO 2013/012680 1/2013

OTHER PUBLICATIONS

PCT International Search Report from PCT/US2013/073458 dated Mar. 4, 2014, 3 pages.

*Primary Examiner* — Abdullah A Riyami
*Assistant Examiner* — Nelson R. Burgos-Guntin
(74) *Attorney, Agent, or Firm* — Michael Stern

(57) ABSTRACT

The present invention relates to cable-to-board connectors for fine pitch, high speed connector assemblies. The exemplary connector assembly includes an insulative housing, a plurality of first contacts disposed in the housing wherein at least a portion of the contacts are adapted to terminate at a conductive trace on a printed circuit board and a first cable comprising a plurality of first wires. Each of the first contacts has a first mating portion for making electrical contact with a corresponding contact of a mating connector; and a first terminal portion extending along a housing bottom wherein the first terminal portion is adapted to terminate at a conductive trace on a printed circuit board. In the exemplary cable assembly, each first wire of the first cable is terminated at the first terminal portion of a different first contact.

14 Claims, 13 Drawing Sheets

(51) Int. Cl.
*H01R 12/71* (2011.01)
*H01R 12/79* (2011.01)
*H01R 13/6581* (2011.01)
*H01R 31/06* (2006.01)

(58) Field of Classification Search
USPC .... 439/607.01, 497, 77, 502, 498, 499, 493, 439/494, 579, 495
See application file for complete search history.

(56) References Cited

U.S. PATENT DOCUMENTS 6,582,252 B1 6/2003 Lin
6,722,915 B1 * 4/2004 McAlonis ..... H01R 12/721 439/493
6,840,798 B2 1/2005 Kobayashi
7,318,730 B2 1/2008 Miyazaki
7,452,238 B1 11/2008 Wu
7,462,065 B1 12/2008 Zhao
7,896,688 B2 * 3/2011 Sukegawa ..... H01R 13/447 439/494
8,585,433 B2 * 11/2013 Honda ..... H01R 24/62 439/499
8,602,812 B2 * 12/2013 Ohsaka ..... H01R 12/775 439/497
8,874,230 B2 10/2014 Niver et al.
9,112,302 B2 * 8/2015 Liao ..... H01R 12/598
2002/0006744 A1 * 1/2002 Tashiro ..... H01R 12/79 439/329
2006/0046569 A1 * 3/2006 Kondou ..... H01R 9/032 439/497
2009/0197459 A1 * 8/2009 Yu ..... H01R 4/027 439/497
2009/0227138 A1 * 9/2009 Lv ..... H01R 12/716 439/466
2012/0077385 A1 * 3/2012 Qiao ..... H01R 27/02 439/628
2012/0090866 A1 4/2012 Gundel
2012/0090872 A1 4/2012 Gundel
2012/0090873 A1 4/2012 Gundel
2012/0097421 A1 4/2012 Gundel
2013/0005192 A1 1/2013 Lim
2013/0045638 A1 * 2/2013 Gui ..... H01R 13/6471 439/660
2013/0316566 A1 * 11/2013 Little ..... H01R 12/7005 439/378
2014/0120788 A1 * 5/2014 Kodaira ..... H01R 12/774 439/892
2014/0206230 A1 * 7/2014 Rost ..... H01R 9/032 439/607.01
2014/0302694 A1 * 10/2014 Qiao ..... H01R 13/6272 439/78
2015/0311612 A1 * 10/2015 Qiao ..... H01R 12/716 439/607.01
2015/0311642 A1 * 10/2015 Rost ..... H01R 9/032 439/607.01
2015/0319861 A1 * 11/2015 Bandhu ..... H05K 1/0228 174/261

* cited by examiner

CABLE-TO-BOARD CONNECTOR

BACKGROUND OF THE INVENTION

Field of the Invention

The present invention relates to cable-to-board connectors, and more particularly to a fine pitch high speed cable-to-board connection system for backplane applications.

Background

Over the last decade, the trend towards more compact, higher speed designs in consumer electronics equipment such as portable communications devices and laptops have led to the development of a variety of low-profile electrical connectors for attaching cables to printed circuit boards (PCB). In order to meet the requirements for high-speed transmission, connectors need to be designed to exhibit superior performance over gigahertz (GHz) frequency ranges. One important design requirement is the reduction of signal degrading phenomena in the connector to a sufficiently low level so that signal quality is not adversely affected. At the same time, other design requirements should be maintained including the mechanical strength of connector components, sufficiently small size and height profile of the connector so that the connector can fit specified spaces, and so on.

The market trend for more compact, higher speed electronics is now being extended into the server market where there is a desire to have micro servers that can perform at the same speed as larger conventional servers. Conventional servers can use backplane connectors which have a 2 mm connection pitch to link server units together. The 2 mm pitch of existing backplane connectors requires larger backplane PCBs than is desired for the micro servers. Thus, a need exists for smaller, fine pitch cable-to-board connectors for high speed applications to help reduce the backplane PCB size, e.g., for the micro server market. The connector should also have improved signal integrity and performance when operating at high data transfer rates over a wide range of frequencies, as well as improved mechanical properties and design features to withstand mechanical stress.

SUMMARY

The present invention relates to cable-to-board connectors, and more particularly to a fine pitch high speed cable-to-board connector assemblies for backplane applications. In a first exemplary embodiment, the connector assembly includes an insulative housing, a plurality of first contacts disposed in the housing, and a first cable comprising a plurality of first wires. Each of the first contacts has a first mating portion for making electrical contact with a corresponding contact of a mating connector; and a first terminal portion extending along a housing bottom wherein the first terminal portion is adapted to terminate at a conductive trace on a printed circuit board. In the exemplary cable assembly, each first wire of the first cable is terminated at the first terminal portion of a different first contact.

In another exemplary embodiment, the connector assembly includes an insulative housing, a plurality of first contacts and a plurality of second contacts disposed in the housing wherein at least a portion of the first and/or second contacts are adapted to terminate at a conductive trace on a printed circuit board, a plurality of first wires terminated at the first contacts, and a plurality of second wires terminated at the second contacts. Each of the first contacts has a first mating portion for making electrical contact with a corresponding contact of a mating connector; and a first terminal portion extending along a housing bottom and each of the second contacts has a second mating portion for making electrical contact with a corresponding contact of a mating connector; and a second terminal portion extending along a housing bottom, wherein the first and second terminal portions are adapted to terminate at a conductive trace on a printed circuit board. Each of the first wires is terminated at the first terminal portion of a different first contact and each of the second wires is terminated at the second terminal portion of a different second contact.

In another exemplary embodiment, the present invention relates to cable connector. The exemplary cable connector includes an insulative housing, a plurality of first contacts, and a cable organizer attached to the insulative housing. Each of the first contacts has a first mating portion for making electrical contact with a corresponding contact of a mating connector; and a first terminal portion extending along a housing bottom wherein the first terminal portion is adapted to terminate at a conductive trace on a printed circuit board. The cable organizer is disposed adjacent to the housing bottom and includes a plurality of first grooves extending along a same first direction and a plurality of first openings, each first opening corresponding to and being in line with a different first groove to access the terminal portions of the plurality of first contacts for connecting wires disposed in each first groove therewith.

In another exemplary embodiment, present invention relates to a cable organizer for use in a cable-to-board connector system. The cable assembly has an organizer base having a central trough, wherein the central trough has a first floor section disposed at a first depth, a second floor section disposed at a second depth and sidewalls extending from the first and second floor sections. A plurality of first grooves extending along the first floor section and parallel to the sidewalls of the central trough, wherein the first grooves aid in the positioning of a plurality of first wires. The cable organizer further includes a plurality of first openings. Each of the first openings corresponds to and is aligned with a different first groove to allow termination of each first wire with a first terminal portion in the connector assembly.

The invention further includes any alternative combination of parts or features mentioned herein or shown in the accompanying drawings. Known equivalents of these parts or features which are not expressly set out are nevertheless deemed to be included.

BRIEF DESCRIPTION OF THE DRAWINGS

The present invention will now be described with reference to the accompanying drawings in which.

While the above-identified drawing figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale. Like reference numbers have been used throughout the figures to denote like parts.

DETAILED DESCRIPTION OF THE DRAWINGS

In the following detailed description of the preferred embodiments, reference is made to the accompanying drawings that form a part hereof. The accompanying drawings show, by way of illustration, specific embodiments in which the invention may be practiced. It should be understood that other embodiments may be utilized and structural or logical changes may be made without departing from the scope of the present invention. The following detailed description, therefore, is not to be taken in a limiting sense, and the scope of the invention is defined by the appended claims.

In order to meet the need for new fine pitch high speed cable assemblies, e.g., for micro server applications, a new fine pitch high speed cable-to-board connector system has been designed. The exemplary cable-to-board connector system includes a new cable mounted connector that can be mated to a conventional fine pitch board mounted connector. In an exemplary aspect, the pitch of wires in an exemplary fine pitch high speed cable can be from about 0.3 mm to about 1.0 mm or preferably from about 0.5 mm to about 0.9 mm depending in part on the diameter of the wires in the cable. Of course the exemplary cable connector and the exemplary cable assembly utilizing the new fine pitch cable connector described herein can accommodate larger wire pitches as well.

In an exemplary aspect, the new high speed cable connector of the present invention and the resulting cable-to-board assembly can be compatible with existing high speed board-to-board connector designs such as described in Patent Cooperation Treaty Publication No. WO2011/119277 and Patent Cooperation Treaty Application No. US2012/046481, herein incorporated by reference in their entirety. By basing the design of the exemplary cable-to-board assembly on conventional high speed board-to board connectors, the intermateability of the new cable connector with a conventional board mount connector is assured. In addition to the smaller size of the new cable-to-board connector system described herein, the new cable-to-board cable system has the advantage that assembly houses will be able to use the conventional board mount connectors for multiple uses thus reducing the number of parts that must be inventoried.

Figure 1:
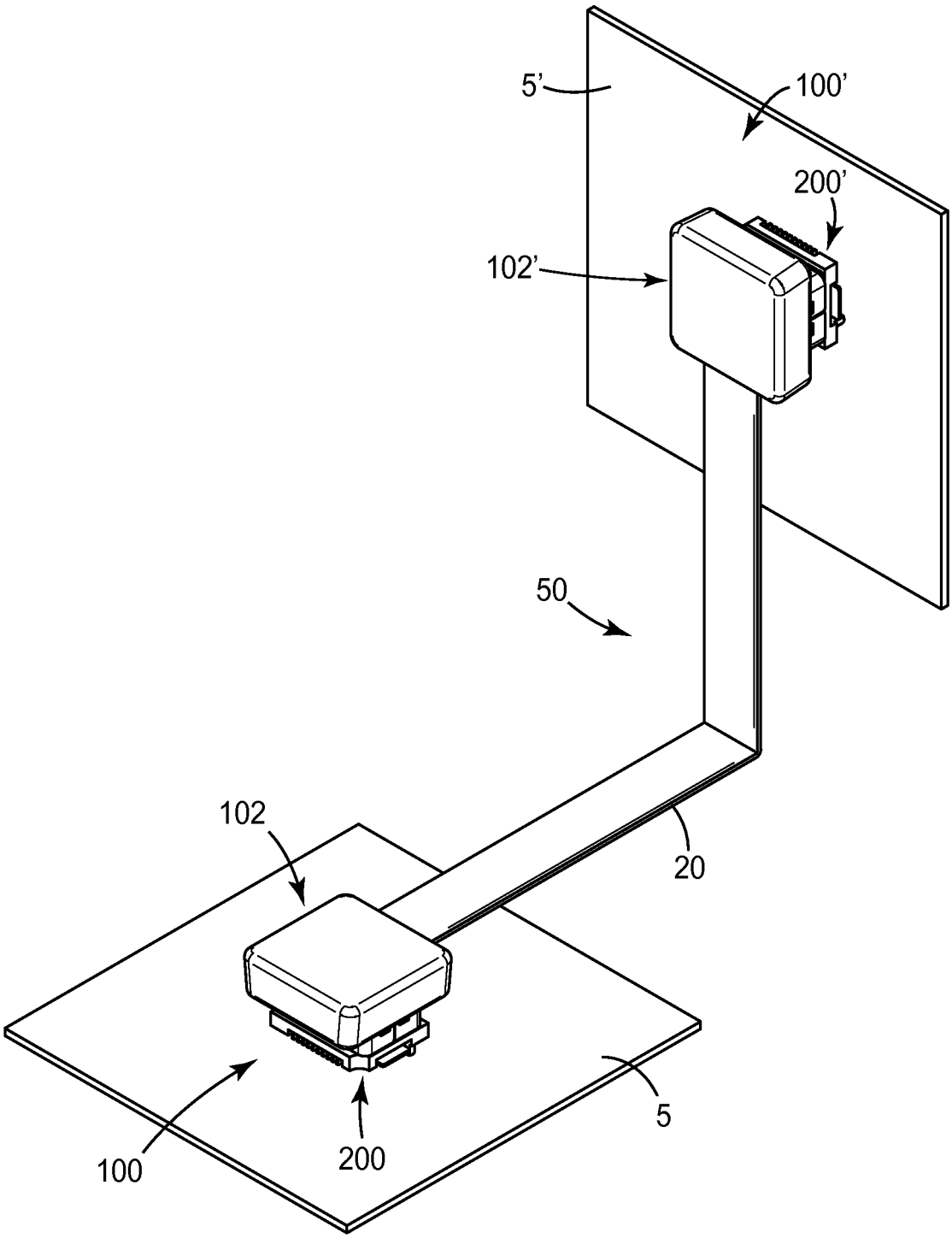
FIG. 1 is a schematic perspective view of a high speed cable-to-board connector system according to an aspect of the current invention.

FIG. 1 shows an example of a high speed cable-to-board cable assembly 50 according to the current invention. Cable assembly 50 has first and second cable connectors 102, 102' mounted on the terminal ends of a high speed cable 20. The first and second cable connectors mate with first and second board mount connectors 200, 200', respectively. The combination of cable connector 102, 102' and board mounted connector 200, 200' make up exemplary cable-to-board connector systems 100, 100', respectively. The exemplary cable assembly can be used to interconnect two printed circuit boards (PCBs) 5, 5' without the need for a backplane connection system, thus improving the design flexibility of electronic equipment having a plurality of PCBs. Alternatively, cable assembly 50 can be used to interconnect two separate pieces of electronic equipment. The exemplary cable assembly can provide a high speed connection (i.e. having data transmission rates up to about 20 Gb/s) between either two PCBs, two pieces of electronic equipment or to connect a piece of electronic equipment to a PCB.

The high speed cable(s) that interconnect first and second cable connectors 102, 102' can include a plurality of electrical conductors or wires. In an exemplary aspect, the high speed cable can be a fine pitch high speed ribbon cable such as are described in US Publication Nos. 2012/0090873, 2012/0090872, 2012/0090866 and 2012/0097421, incorporated by reference herein in their entirety. The cables in these references enable a higher conductor density than other conventional electrical ribbon cables. In one exemplary aspect, the conductor to conductor pitch in the cable will approximate the contact spacing in the connector assembly. Other exemplary cables can include, for example, Ribbon X (38 & 40 AWG Ribbon Coax) and Bulk 0.050" Pitch Flat Ribbon Cable, both available from Hitachi Cable, Inc.

Figure 2:
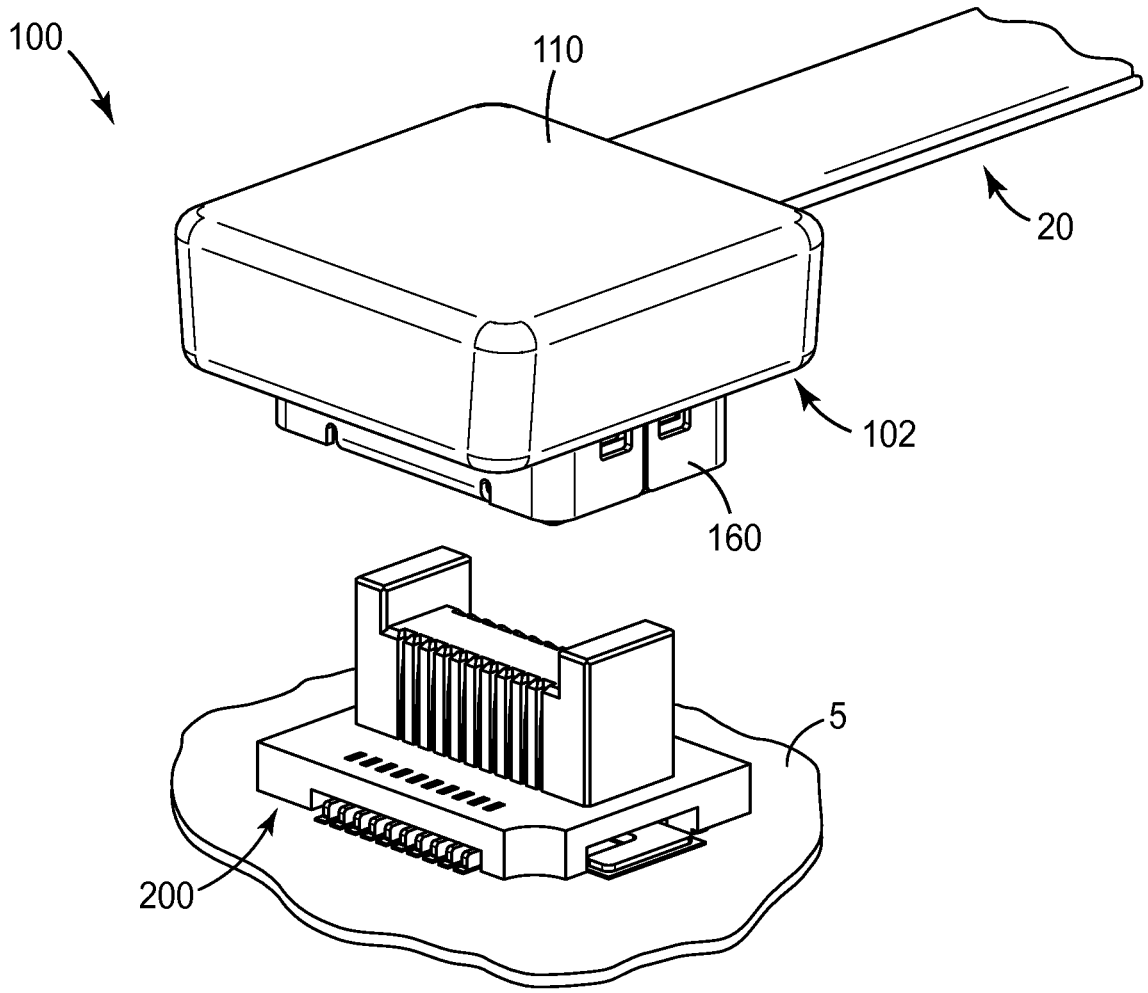
FIG. 2 is a perspective view of an exemplary cable-to-board connector system according to an aspect of the current invention.
Figure 3:
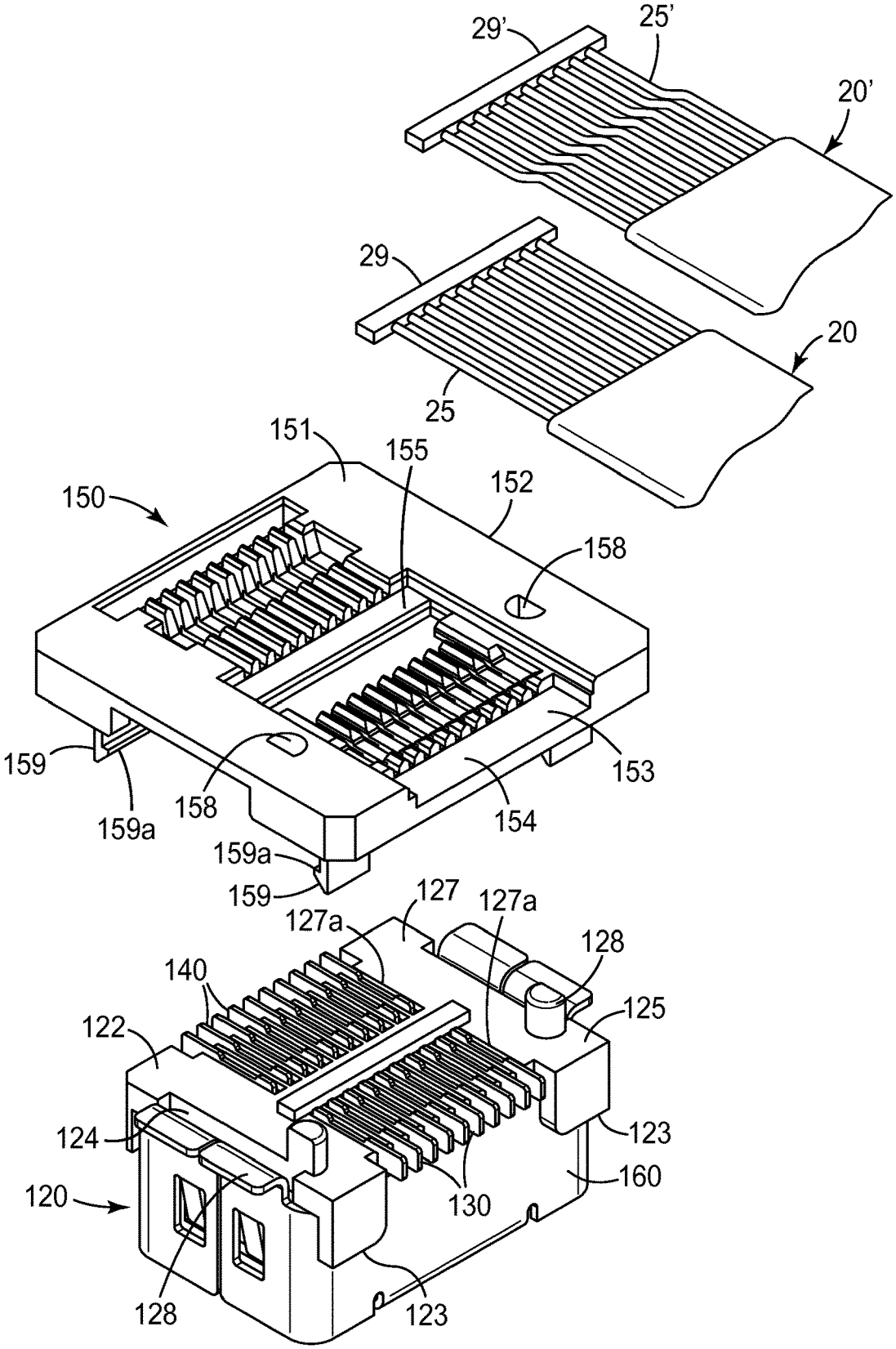
FIG. 3 is an exploded perspective view of a portion of the cable-to-board connector system of FIG. 2.

FIG. 2 shows cable-to-board connector a 100 in accordance to an embodiment of the present invention in a disconnected state. In the exemplary aspect shown in FIG. 2, cable-to-board connector system 100 includes a socket-style cable connector 102 that mates with a plug-style board mounted connector 200 that is attached to PCB 5. In an alternative aspect, cable-to-board connector system can include a plug-style cable connector that mates with a socket-style board mounted connector that is attached to the PCB, which will be described later with respect to FIGS. 8 and 9. While the exemplary cable to board connector assembly can have either a plug configuration or a socket configuration, the exemplary socket-style cable connector 102 will be described in detail below with respect to FIGS. 2-5D.

Referring to FIGS. 2, 3 and 4A-4B, cable connector 102 can include a connection base 120, a cable organizer 150 and a cap 110.

Connection base 120 can include an insulative housing 122 configured to hold a plurality of first contacts 130. Insulative housing 122 includes a recess 125 defined by a pair of side walls 126 extending from housing base 127. The sidewalls surrounding recess 125 can be connected to one another at their ends by a pair of end walls 124.

In an exemplary aspect, the insulative housing 122 of connection base 120, the cable organizer 150 and the cap 110 can be formed using an injection molding process with an engineering resin such as a glass filled liquid crystal polymer resin, a polybutylene terephthalate (PBT) resin, a polycarbonate resin, etc.

Housing base 127 can have a plurality of contact channels 127*a* formed in the outside surface of the housing base. Each contact channel 127*a* can have a contact opening 127*b* through the bottom of the each contact channel 127*a* to allow passage of a portion of a first contact 130 through the housing base into the recess 125 and into a corresponding contact channel 126*a* formed in an inner surface of at least one of the side walls 126.

In an exemplary aspect, connection base 120 can include a plurality of retention devices (not shown) disposed on the outside surface of the insulative housing 122 to allow attachment of an optional supplementary shield plate 160. The supplementary shield plate 160 can provide additional EMI shielding from the external environment to the cable connector 102. Thus, for applications where it is not critical to provide good EMI shielding from the external environment, the connector assembly may not require the supplementary shield plate.

In one exemplary aspect, each of the first contacts 130 can be generally "L" shaped. Each first contact 130 has a first mating portion 132 disposed within contact channel 126*a* formed in one of the side walls 126, 126' and extending into housing recess 125 for making electrical contact with a corresponding contact of a mating connector and a first terminal portion 134 extending along the housing base in contact channel 127*a*. The first terminal portion can be adapted to terminate at a conductive trace on a printed circuit board if the connection base were used in a board-to-board connection or it can be adapted to terminate wires in a cable to a board mounted connector (for example, board mounted connector 200 shown in FIG. 2) as is being described herein. Thus, in the exemplary cable-to-the-board connector of the present invention, each of the first terminal portions can be used to terminate a wire 25 of high speed cable 20.

Figure 4A:
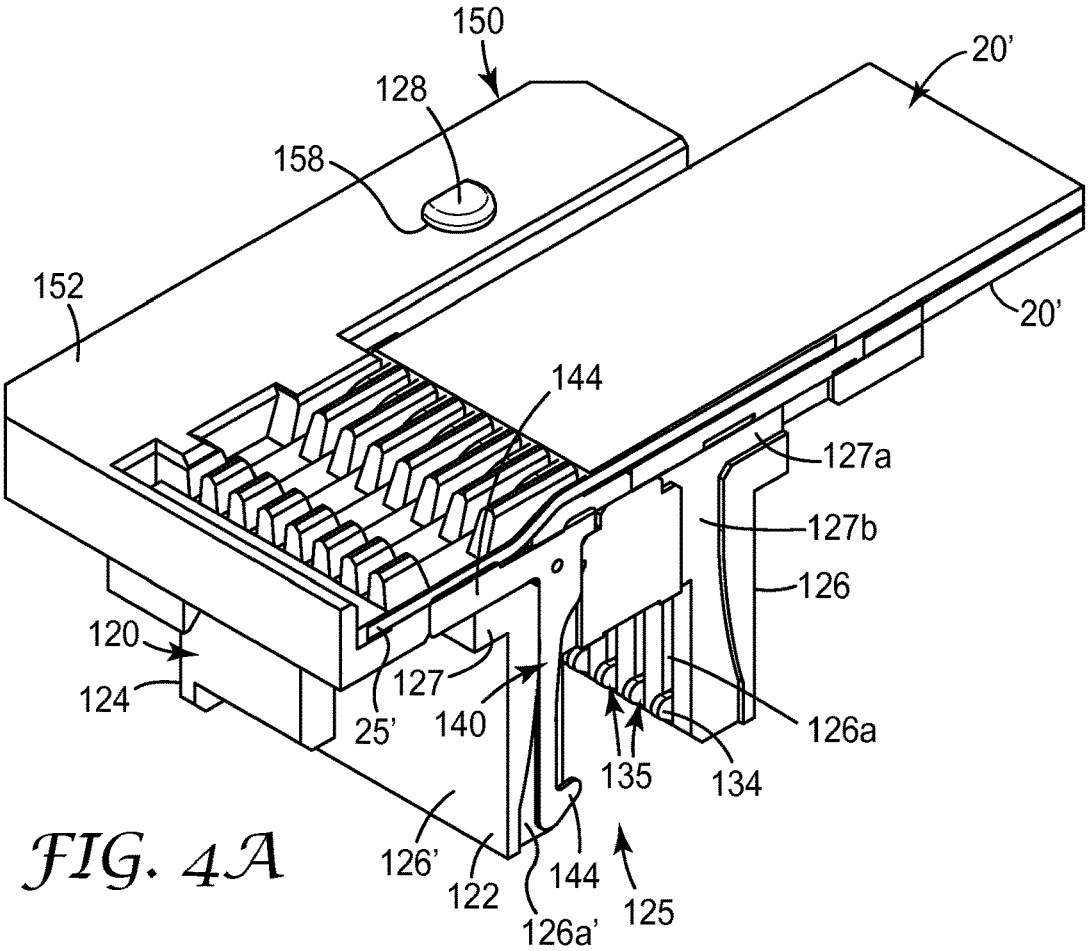
FIG. 4A is a perspective sectional view of a portion of the cable-to-board connector system of FIG. 2.

In an exemplary aspect, cable connector 102 can further include a plurality of second contacts 140. Second contacts 140 can also be generally "L" shaped. Each second contact 140 has a second mating portion 142 disposed within contact channel 126*a*' formed in side wall 126' of the insulative housing 122. The second contacts extend into housing recess 125 for making electrical contact with a corresponding contact of the mating connector. Each second contact includes a second terminal portion 144 extending along the housing base in contact channel 127*a*. The second terminal portion can be adapted to terminate at a conductive trace on a printed circuit board if the connection base were used in a board-to-board connector or it can be adapted to terminate wires in a cable-to-the-board connection system of the present invention. Thus, each of the second terminal portions can be used to terminate a wire 25' of a second high speed cable 20' as shown in FIG. 4A.

Cable organizer 150 can be attached to the connection base 120 to aid in aligning the wires 25, 25' of one or more high speed cables 20, 20' with the contacts 130, 140 disposed in the connection base. Specifically, the connection base 120 can include one or more alignment posts 128 that mate with alignment holes 158 disposed through the cable organizer. In the exemplary aspect shown in the figures, the alignment posts 128 and corresponding alignment holes 158 have a D-shape to aid in positioning of the cable organizer on the connection base. However alternative shapes such as square posts and holes, cylindrical posts and holes, etc. are possible and the shape of the alignment posts and corresponding alignment holes shall not be deemed limiting with respect to the exemplary cable-to-board connector system described herein.

Figure 4B:
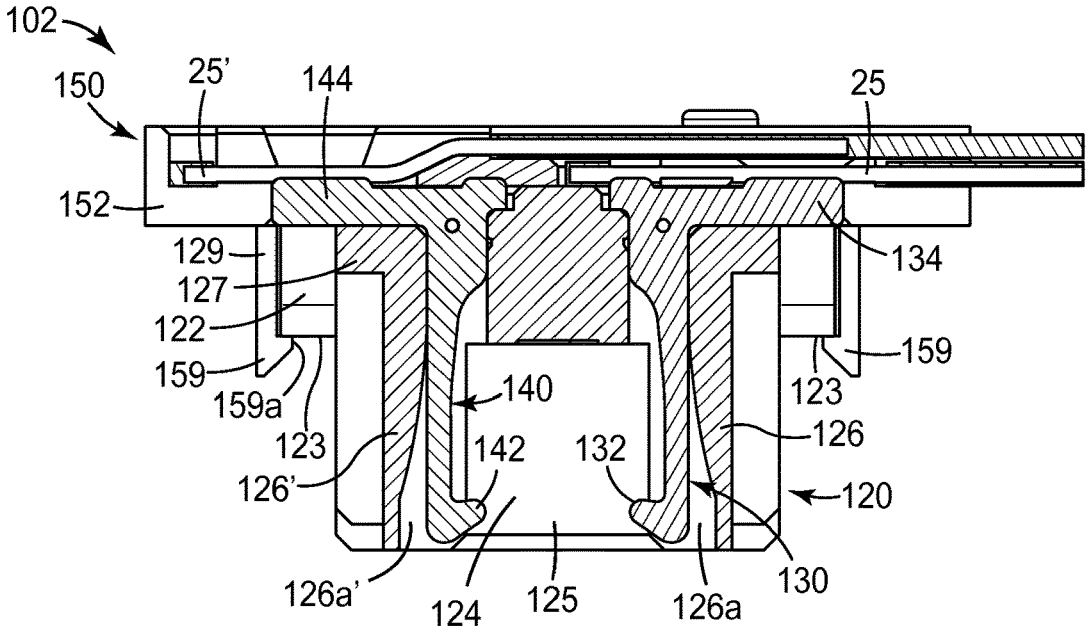
FIG. 4B is a cross-sectional view of a portion of the cable-to-board connector system of FIG. 2.

In addition, cable organizer 150 includes an organizer base 152 that can have a plurality of latch arms 159 extending from its lower surface to attach the cable organizer to connection base 120. Latch arms 159 can include a barbed projection 159*a* that can engage with shoulder 123 of the insulative housing 122 as shown in FIG. 4B.

Figure 5A:
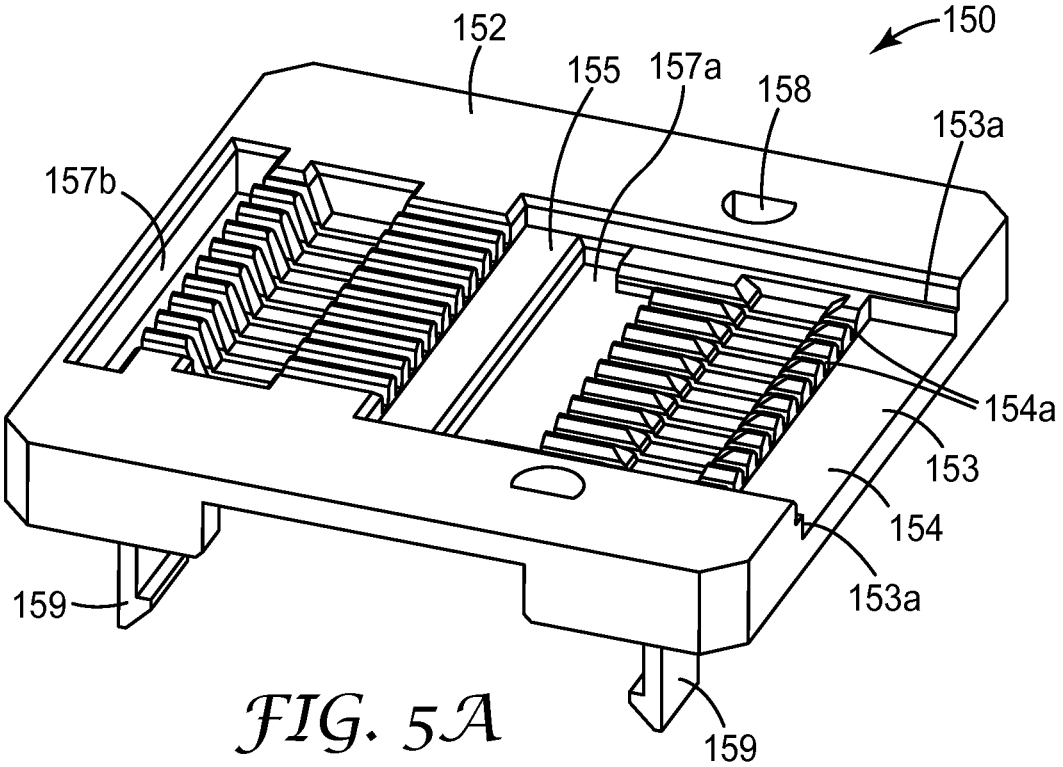
FIGS. 5A-5D are four views of an exemplary cable organizer according to an aspect of the current invention.
Figure 5B:
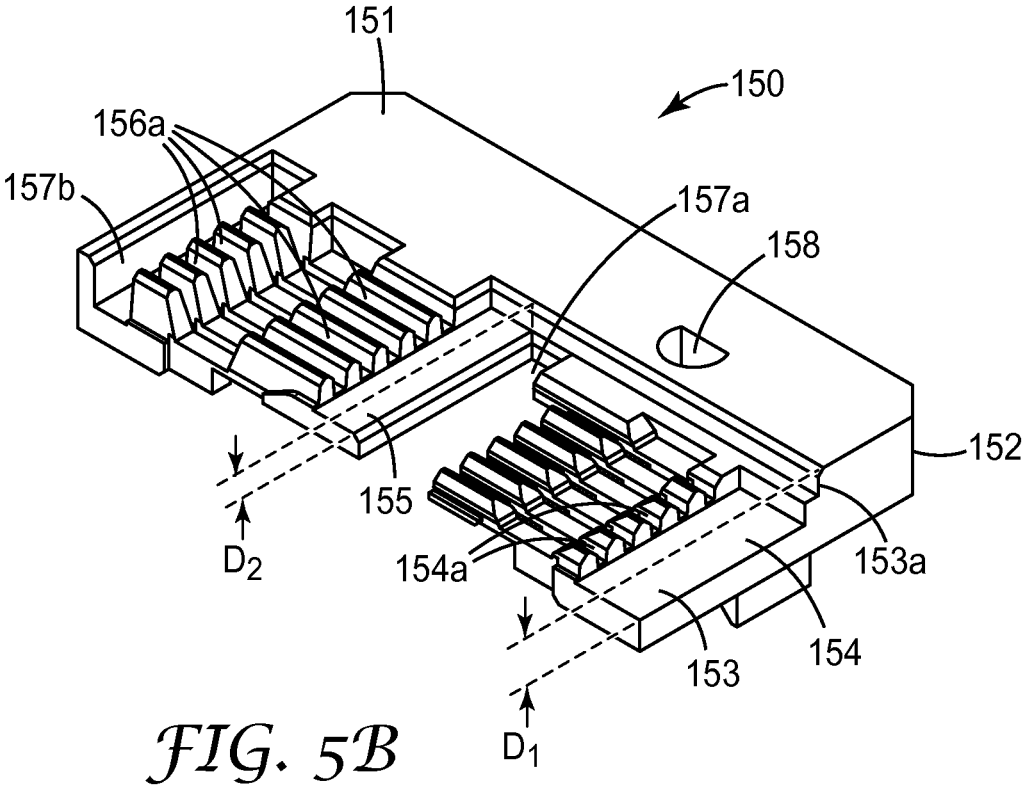
Figure 5C:
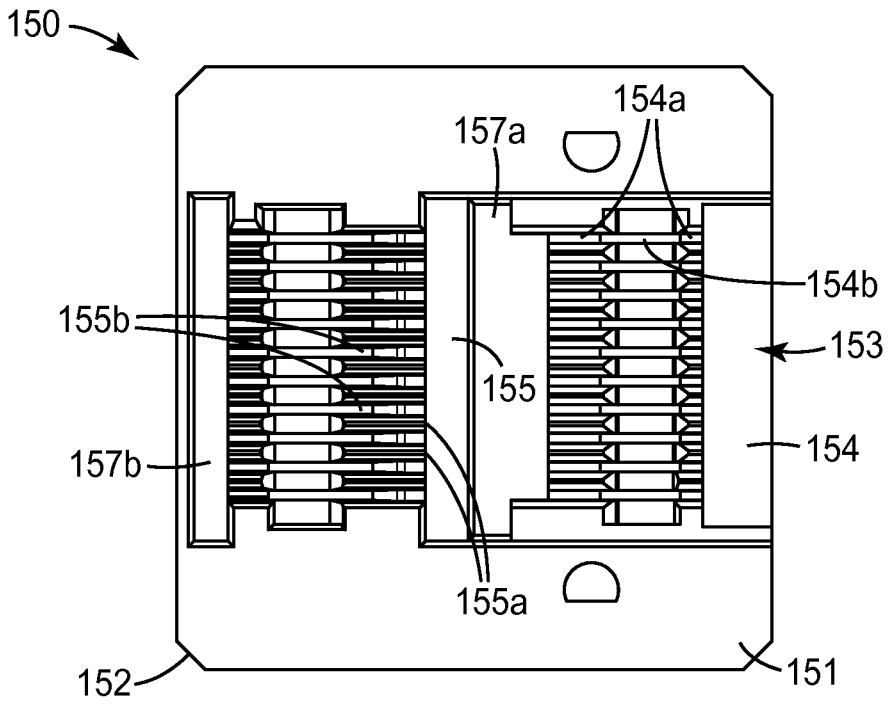
Figure 5D:
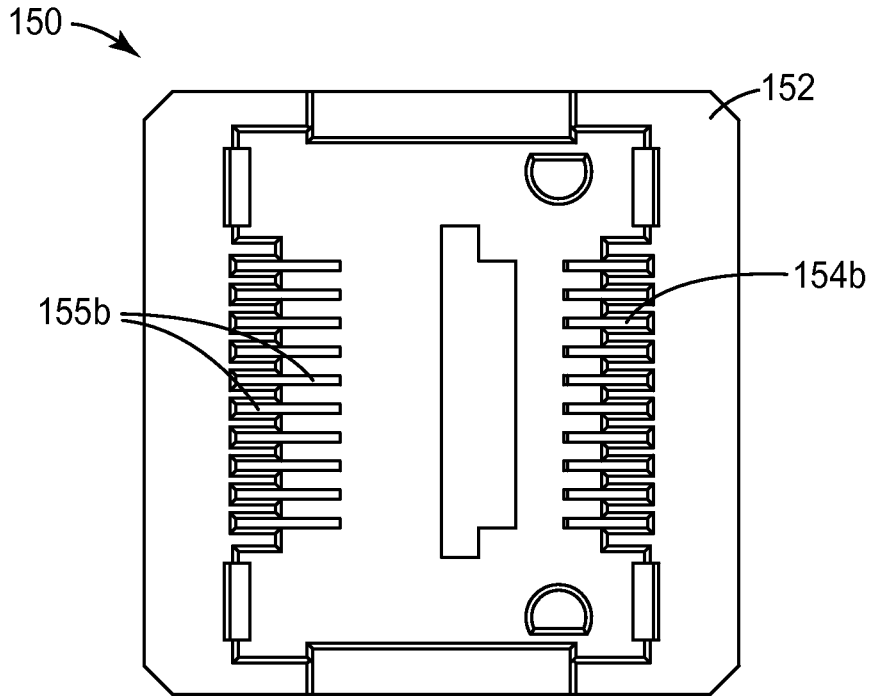

FIGS. 5A-5D show four views of the exemplary cable organizer in accordance with an embodiment of the current invention. FIG. 5A is an isometric view of cable organizer 150. FIG. 5B is a sectional view of cable organizer 150 and FIGS. 5C and 5D are a top view and a bottom view, respectively, of cable organizer 150.

Organizer base 152 of cable organizer 150 includes a central trough 153 formed in the top surface 151 thereof. In one exemplary aspect, central trough 153 can vary in depth from the open end of the central trough to the closed end of the central trough. For example, the central trough can include a first floor section 154 adjacent to the open end of the central trough disposed a first depth, $D_1$ relative to the top surface 151 of the cable organizer; and a second floor section 155 between the open and closed ends of the central trough disposed at a second depth, $D_2$ relative to the top surface 151 of cable organizer 150. In one exemplary aspect, the first floor section is disposed at a greater depth than the second floor section (i.e. $D_1>D_2$).

Figure 7A:
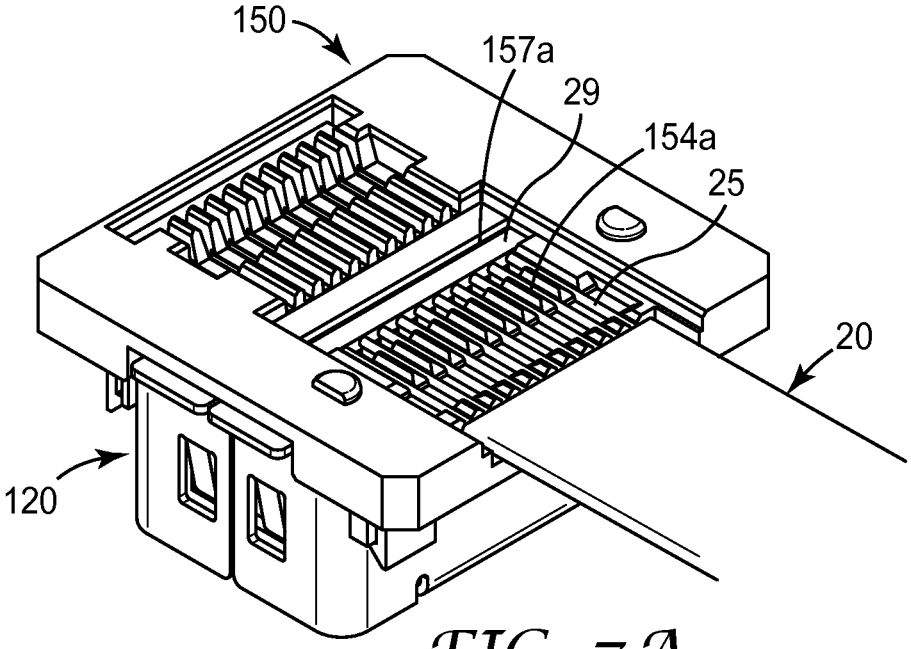
FIGS. 7A-7G are seven views illustrating the termination process of a cable with the exemplary high speed cable-to-board cable of the current invention.
Figure 7B:
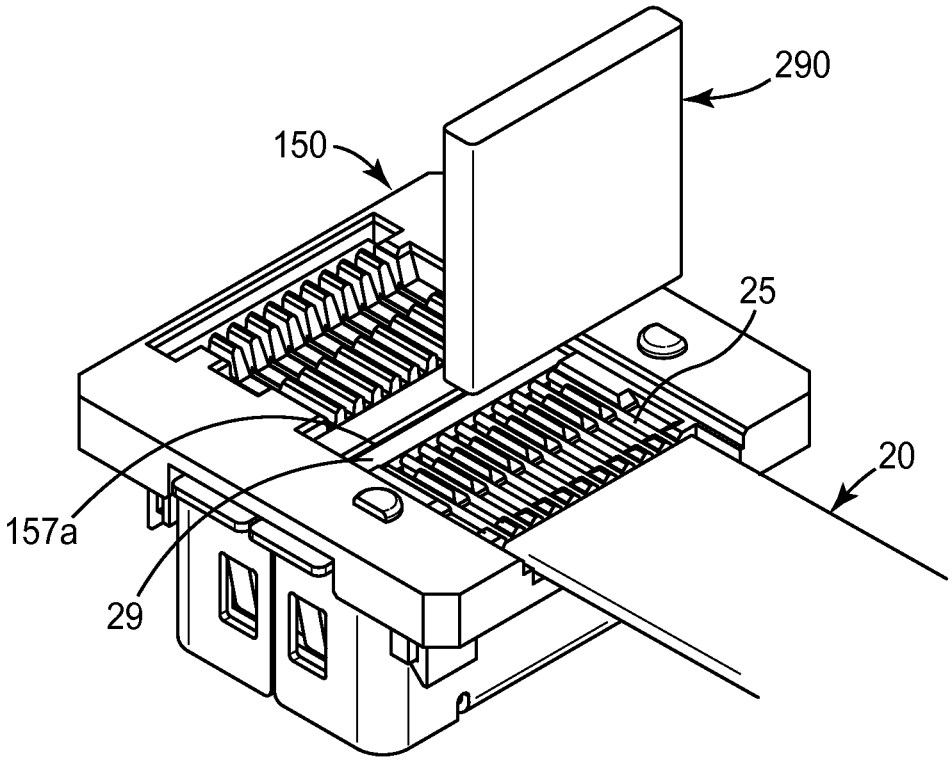
Figure 7C:
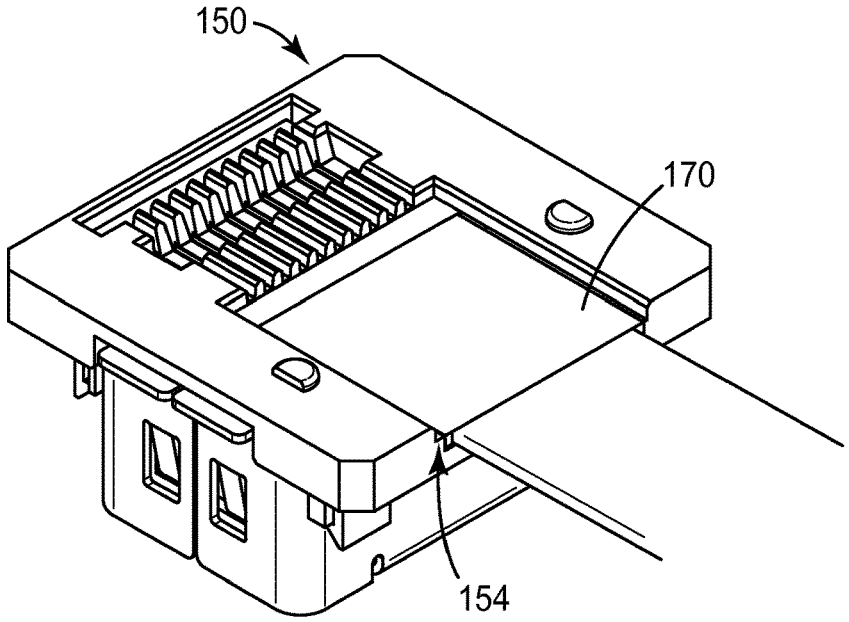

Additionally, the organizer base 152 can include a first nesting section 157*a* disposed adjacent to the first floor section. The first nesting section is configured to accept a terminal anchor 29 disposed on the terminal end of the plurality of wires 25 of exemplary high speed cable 20 as illustrated in FIG. 7A. Similarly, organizer base 152 can include a second nesting section 157*b* disposed adjacent to the second floor section 155. The second nesting section is configured to accept a terminal anchor 29' disposed on the terminal end of the plurality of wires 25' of exemplary high speed cable 20' as illustrated in FIG. 7E. In at least one aspect, the terminal anchors 29, 29' disposed on the terminal ends of the plurality of wires of the exemplary high speed cables 20, 20; serve to anchor and provide strain relief of the exemplary cable(s) terminated in the exemplary cable assembly.

Organizer base 152 includes a plurality of first grooves 154*a* extending along the first floor section 154 and parallel to the side walls 153*a* of the central trough 153 and a plurality of first openings 154*b* through the organizer base. Each first opening 154*b* corresponds to and is aligned with a different first groove 154*a* for the positioning each first wire relative to the first contacts disposed in the connection base. In an exemplary aspect, each of the first grooves 154*a* can be substantially parallel to the side walls 153*a* of the central trough. The substantially parallel grooves are configured to accept wires of the high speed cable that have the same approximate pitch as the contacts in the connector assembly. In another exemplary aspect, the first grooves can be disposed in a funnel shape to accept wires from a high speed cable where the pitch of the wires is greater than the pitch of the contacts in the connector assembly, but this may require manual alignment of some or all of the wires.

The exemplary embodiment of the cable connector 102, is configured to terminate two sets of wires (i.e. first wires 25 and second wires 25') in an offset configuration. To accomplish this, the organizer base 152 can further includes a plurality of second grooves 155*a* extending between the second floor section 155 and a second nesting section 157*b* disposed adjacent to the closed end of central trough 153. Each of the second grooves can be substantially parallel to the side walls 153*a* of the central trough 153 and can position the plurality of second wires 25' relative to the second contacts 140 disposed in the connection base as shown in FIG. 4B. Each of the second grooves includes a second opening 155*b* through the organizer base 152. Each second opening 155*b* corresponds to and is aligned with a different second groove 155*a*. The substantially parallel second grooves 155*a* are configured to accept a plurality of second wires 25' from a high speed cable 20', and align them with the second terminal portion 144 of the second contacts which extend through the second openings of the cable organizer. Exemplary cable organizer 150 is designed such that the plurality of second wires of the second high speed cable have the same approximate pitch as the second contacts in the connector assembly. The design of organizer can be modified to accept wires having either a finer or coarser pitch than the contacts disposed in the connection base and are considered to fall within the scope of the current disclosure.

Figure 7D:
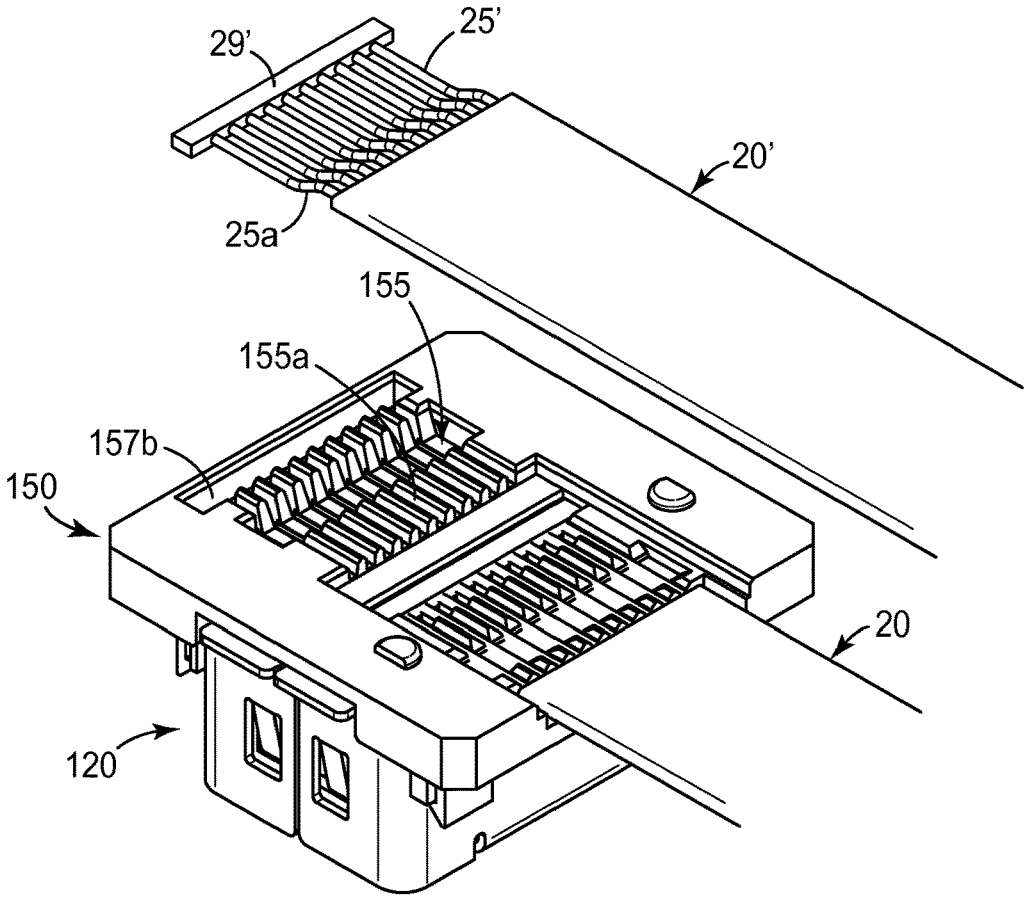
Figure 7E:
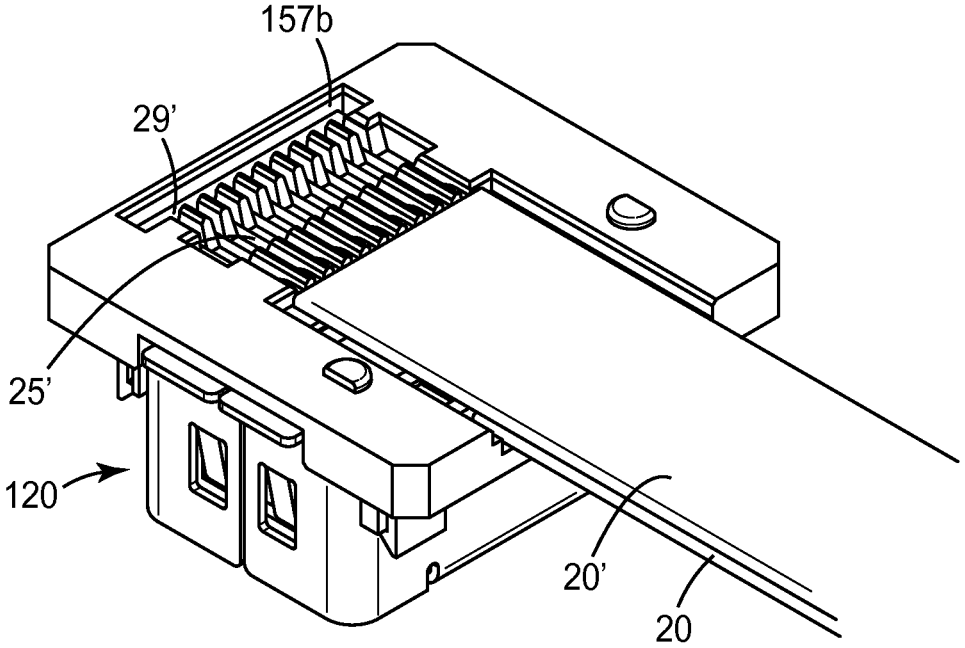

As previously mentioned, the second nesting section 157*b* disposed adjacent to the closed end of the central channel is configured to accept a terminal anchor 29' disposed on the terminal ends of the plurality of wires of the second high speed cable 20' as illustrated in FIGS. 7D and 7E. Terminal anchor 29' aids in anchoring the second high speed cable 20' in cable organizer 150 and in providing strain relief of the second the second high speed cable 20' terminated cable connector 102.

Thus, the first grooves generally lie in a first plane at a first depth and the second grooves generally lie in a second plane at a second depth and offset from the grooves of the first plane. In one exemplary aspect, the first and second openings can lie in the same plane.

In one exemplary aspect, the plurality of first grooves can be aligned with the plurality of second grooves disposed within the base of the cable organizer. The first grooves can be disposed at a first depth within the central trough and the second grooves can be disposed at a second depth within the central trough. In this way the density of electrical connections can be increased without increasing the length of the connector assembly. In an exemplary aspect, cable connector 102 can be used to terminate the wires 25, 25' in two separate high speed cables as shown in FIG. 4B while in another aspect, the cable connector can be used to terminate the wires in a high speed cable that includes two parallel rows of wires. Alternatively, the cable organizer can accommodate a plurality of smaller high speed cables disposed on each tier (at each depth) so long as there are a sufficient number of contacts to accommodate the wires within the plurality of cables on a given tier.

In an alternative embodiment, the grooves in the cable organizer can have a staggered arrangement to accommodate high speed cables wherein the electrical conductors are arranged in a staggered arrangement or wherein the contacts disposed in the connection base are disposed in a staggered arrangement.

Also, while exemplary cable connector 102 is described herein as having a plurality of rows of contacts (i.e. first contacts 130 and second contacts 140), embodiments of exemplary cable assembly may contain a single row of contacts such that, an exemplary cable connector can include an insulative housing, a plurality of first contacts disposed in the housing wherein at least a portion of the contacts are adapted to terminate at a conductive trace on a printed circuit board and a cable organizer attached to the insulative housing. Each of the first contacts has a first mating portion for making electrical contact with a corresponding contact of a mating connector; and a first terminal portion extending along a housing bottom wherein the first terminal portion is adapted to terminate at a conductive trace on a printed circuit board. The cable organizer is disposed adjacent to the housing bottom and includes a plurality of first grooves extending along a same first direction and a plurality of first openings, each first opening corresponding to and being in line with a different first groove to access the terminal portions of the plurality of first contacts for connecting wires disposed in each first groove therewith.

While in another embodiment the exemplary cable connector can include more than two rows of contacts and the number of rows of contacts is considered a matter of design choice and, therefore, deemed to fall within the scope of the current invention.

Advantageously, cable organizer 150 allows for the direct termination of wires via a mass soldering process with the contacts housed in the connection base of the cable connector 102. For example, each of the first wires 25 can be terminated at first terminal portion 134 of each of the first contacts 130 within the connection base. In an exemplary aspect, the wires are terminated to the first and second contacts via a soldered connection. For example, a hot bar soldering process may be used that allows simultaneous connection of the wires 25 to first contacts 130 as shown in FIG. 4B. Similarly, each of the second wires 25' can be terminated at the second terminal portion 144 of each of the second contacts 140 within the connection base of cable connector 102 by a mass soldering process.

In an exemplary aspect, the connection base 120 can be the second half of a board-to-board connector system. Thus, cable organizer 150 allows wires from a high speed cable to be directly terminated to contacts of the connection base that were originally adapted to be soldered to a printed circuit board. Using one half of a board-to-board connection system in the exemplary cable connector ensures the fine pitch connectivity of the resulting cable-to-board connection system, such as connector system 100 shown in FIGS. 1 and 2.

While the cable organizer 150 is provided with first and second grooves 154*a*, 155*a* which allow the plurality of wires in a high speed cable to be aligned easily with the terminal portions 134, 144 of contacts 130, 140, respectively, the wires may need to be individually aligned in the first and second grooves 154*a*, 155*a*. To simplify the alignment process, terminal anchor 29 is formed on the terminal ends of the plurality of wires 25 of the high speed cable 20 by a new cable preparation process, described in more detail below. The terminal anchor sets the proper spacing between adjacent wires to allow all of the wires to be inserted into the first or second grooves of the cable organizer when the terminal anchor is placed in one of the nesting sections 157*a*, 157*b*. The terminal anchor can additionally serve as a stop or a strain relief device to prevent removal of the cable from the cable connector when a longitudinal force is applied to the cable thus improving the reliability of the resulting connector system 100.

Figure 7F:
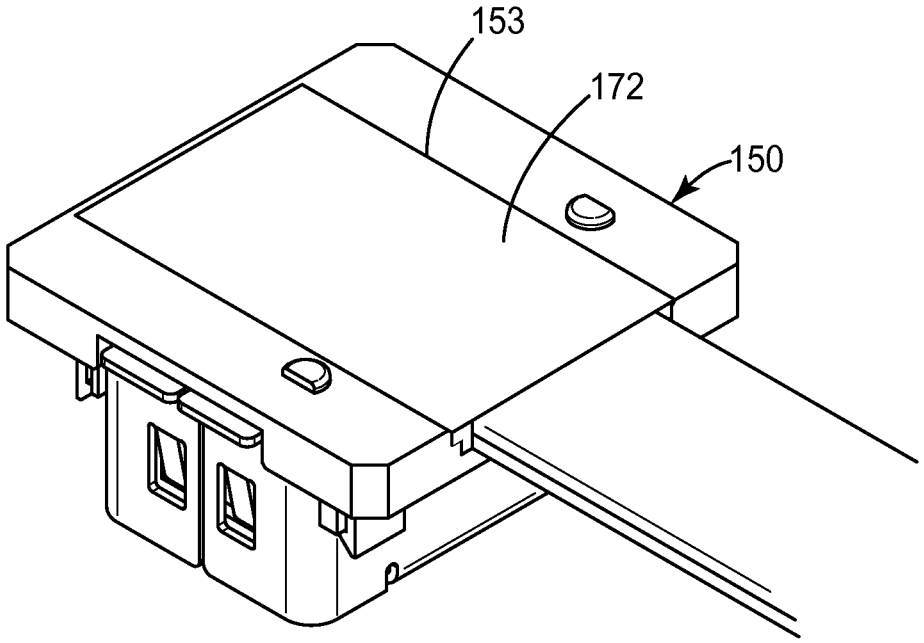
Figure 7G:
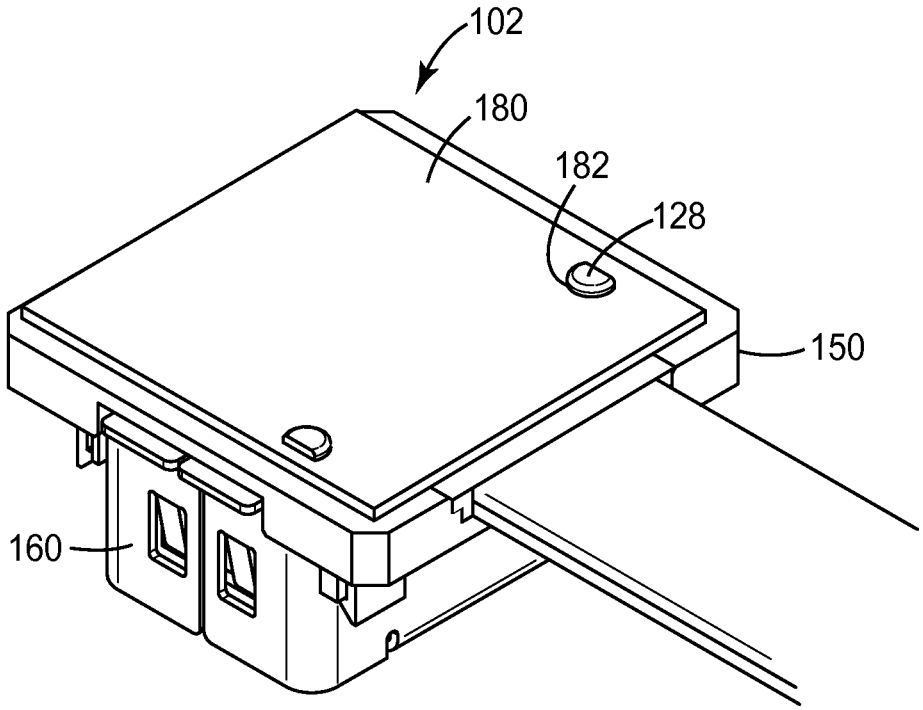

The exemplary cable connector 102 can further include an optional shielding plate 180 shown in FIG. 7G. The shielding plate can be disposed over the central trough 135 of cable organizer 150 to provide EMI shielding to the bare wires disposed within the central trough. Optional shielding plate 180 can be positioned on top of the cable organizer using the alignment posts 128 of the connection base 120 in conjunction with the alignment openings 182 in the shielding plate. In an exemplary aspect, shielding plate can be formed from a sheet of metal such as a sheet of copper or a sheet of aluminum, for example, although other metals can be used. Use of the optional shielding plate in conjunction with supplementary shield plate 160 disposed around the insulative housing of the connection base can form a pseudo-faraday cage structure around the bare wires disposed within the cable connector. This shielding is configured to prevent external EMI signals from entering the cable to board assembly, and adversely affecting the high speed signal connection made by the assembly. The shielding plate can be useful in reducing electromagnetic interference in high speed applications or very dense circuit board designs.

Finally, cap 110, shown in FIG. 2, can be overmolded over the top portion of the connection base 120 and the cable organizer 150 to produce the final cable connector 102. In an alternative aspect, a snap-on plastic cap may be used. The cap can be made of a moldable plastic material such as a polybutylene terephthalate (PBT) resin, a liquid crystal polymer (LCP) resin, a polycarbonate resin, etc.

Figure 6A:
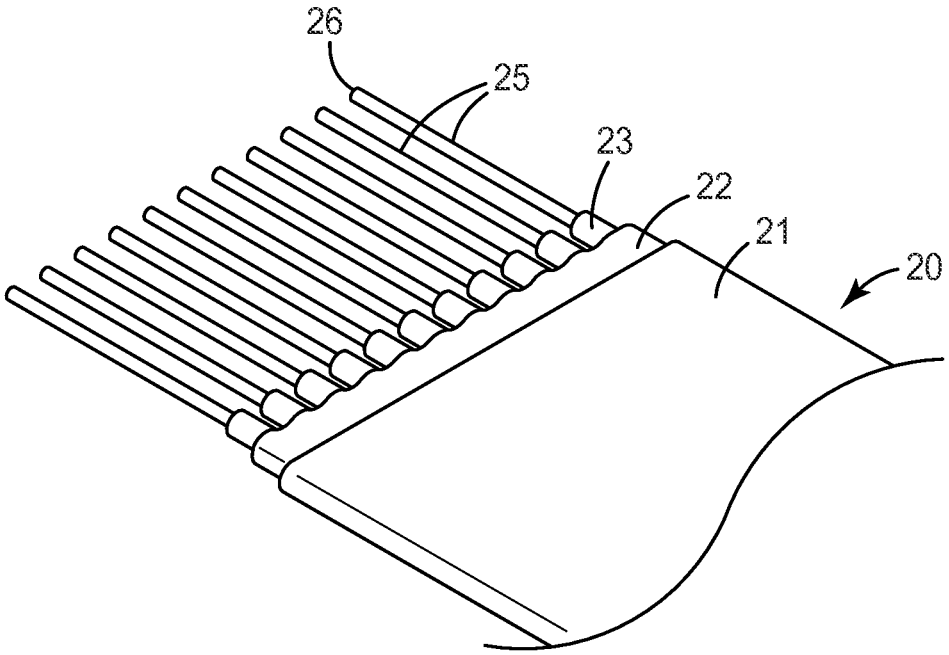
FIGS. 6A and 6B are two views that illustrate the preparation of a cable to be terminated in the exemplary high speed cable-to-board cable of the current invention.
Figure 6B:
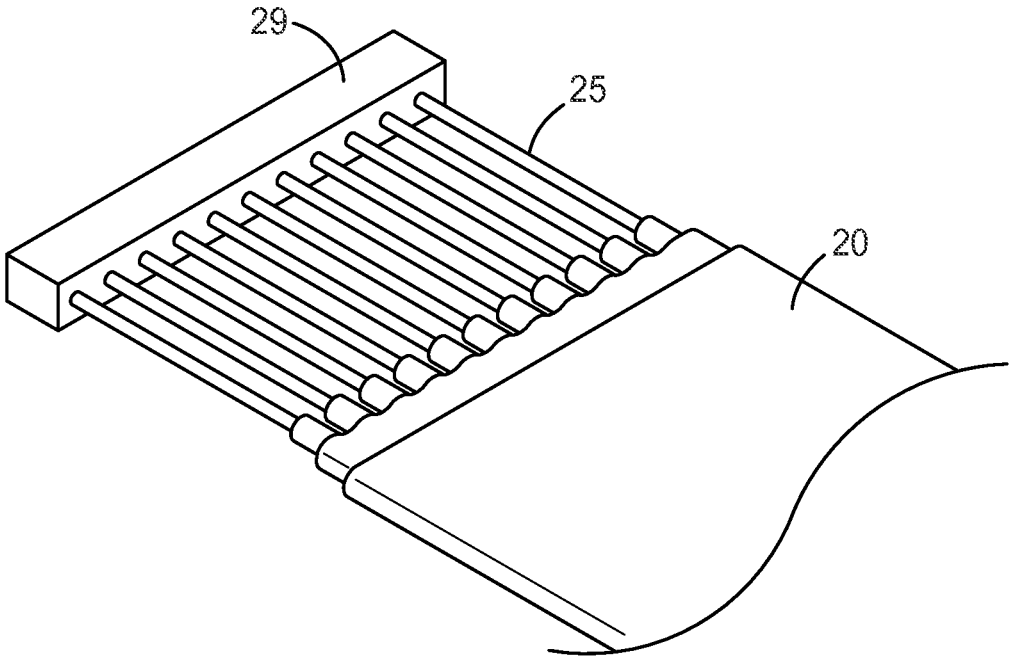

The exemplary cable assembly can be prepared as follows with reference to FIGS. 6A-6B and 7A-7G. FIGS. 6A and 6B show the preparation of a high speed cable 20 having a plurality of electrical conductors or wires 25. The cable is prepared by first removing a section of the cable jacket 21 adjacent to the terminal end of the cable. The shielding layer 22, if present, can be trimmed back to expose the wires within the cable. The insulating coating 23 on the conductors is removed to leave an exposed section of each wire 25 adjacent to their terminal end 26.

The terminal anchor 29 is molded over the terminal ends 26 of the wires 25 such that the terminal ends of the wires are encased in the terminal anchor as shown in FIG. 6B. The terminal anchor can be formed by inserting the terminal ends of the wires into a mold cavity and injecting an appropriate molding material into the cavity and allowing it to either cool or cure such that the terminal ends of the wires are securely held within the terminal anchor at known wire spacing. The wire spacing will be approximately the same as the groove pitch of the cable organizer. The molding material can be selected from a thermoplastic resin such as LCP resin which and be injection molded around the wires to form the terminal anchor, a reactive resin material or a thermosetting potting material such as an epoxy resin.

Solder paste is applied to the bare wires 25 between terminal anchor 29 and the cable jacket 21 or insulating coating 23 on each wire, depending on the design of the cable. An exemplary solder paste material can be a conventional tin-lead solder paste or a conventional lead free solder paste.

Referring now to FIGS. 7A-7G, a prepared first high speed cable 20 is placed into the cable organizer 150 which has been mounted on connection base 120 of the exemplary connector assembly so that each first wire 25 is disposed in a different first groove 154*a* and the terminal anchor 29 on the prepared cable rests in the first nesting section 157*a* in the cable organizer as shown in FIG. 7A.

Referring to FIGS. 4B and 7B, the first wires 25 can be terminated to the first contacts 130 (FIG. 4B) by a hot bar soldering process in which a thermode 290 of the soldering apparatus is brought into contact with the solder paste coated first wires. The solder paste will melt and flow into the first openings in the cable organizer to contact the first terminal portion 134 of the first contacts 130 to provide an electrical connection between the first wires and the first contacts.

Next, the solder connections between the first wires and the first contacts can be stabilized by applying a conventional potting material 170 such as an epoxy based potting material to the first floor section 154 of the cable organizer 150 as shown in FIG. 7C. The potting material can be a two part material, UV curable material or a thermally curable material.

A second high speed cable 20' is prepared as described above. In addition the second wires 25' of the second cable can have a bent region 25*a* to compensate for the positioning of the second cable in cable organizer 150 as shown in FIG. 7D. The prepared second high speed cable 20' is placed into the cable organizer 150 which has been mounted on connection base 120 of the exemplary connector assembly so that each second wire 25' is disposed in a different second groove 155*a* and the terminal anchor 29' on the prepared cable rests in the second nesting section 157*b* of the cable organizer as shown in FIG. 7E.

The second wires 25' can be terminated to the second contacts 140 (FIG. 4B) as described above. The solder connections between the second wires and the second contacts can be stabilized by filling the remaining space in the central trough 153 of the cable organizer with a conventional potting material 172 as shown in FIG. 7F. Alternatively, the solder connections between the first wires and the first contacts and between the second wires and the second contacts can be stabilized at the same time by filling the trough of the cable organizer with a conventional potting material and curing that material.

Next, an optional shielding plate 180 can be place on top of the cable organizer 150 such that the alignment posts 128 of the connection base mate with the alignment openings 182 in the shielding plate to provide additional EMI protection the connections housed within cable connector 102.

Finally cap 110 can be overmolded over the top portion of the connection base 120 and the cable organizer to produce the final cable connector 102 shown in FIG. 2.

While the connector assembly described above has been based on a conventional board-to-board socket connector, the techniques and teachings can be readily applied to a conventional plug style board-to-board connector as well and will be described briefly with respect to FIGS. 8 and 9.

Figure 8:
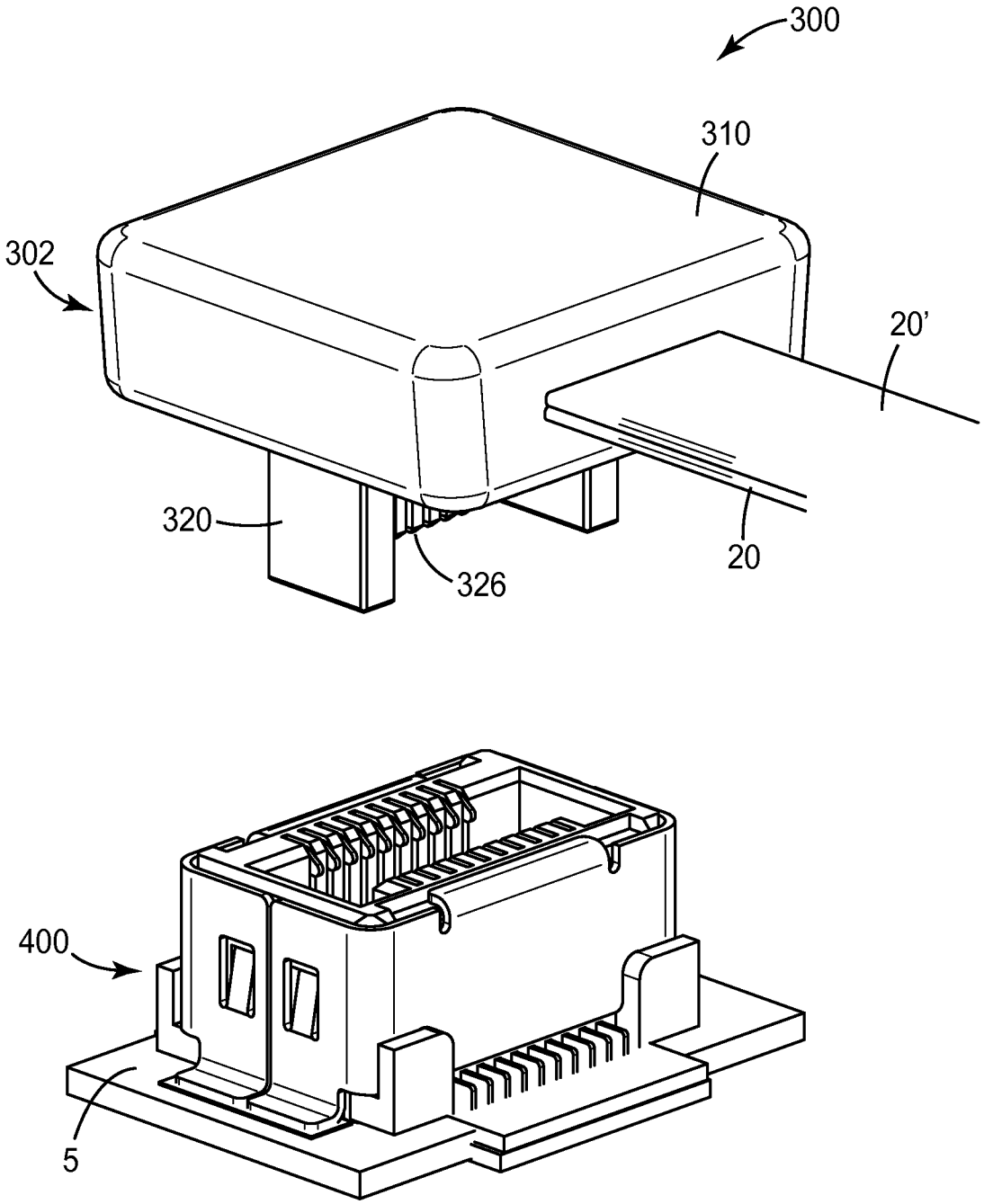
FIG. 8 is a perspective view of another exemplary high speed cable-to-board connector system according to an aspect of the current invention.
Figure 9:
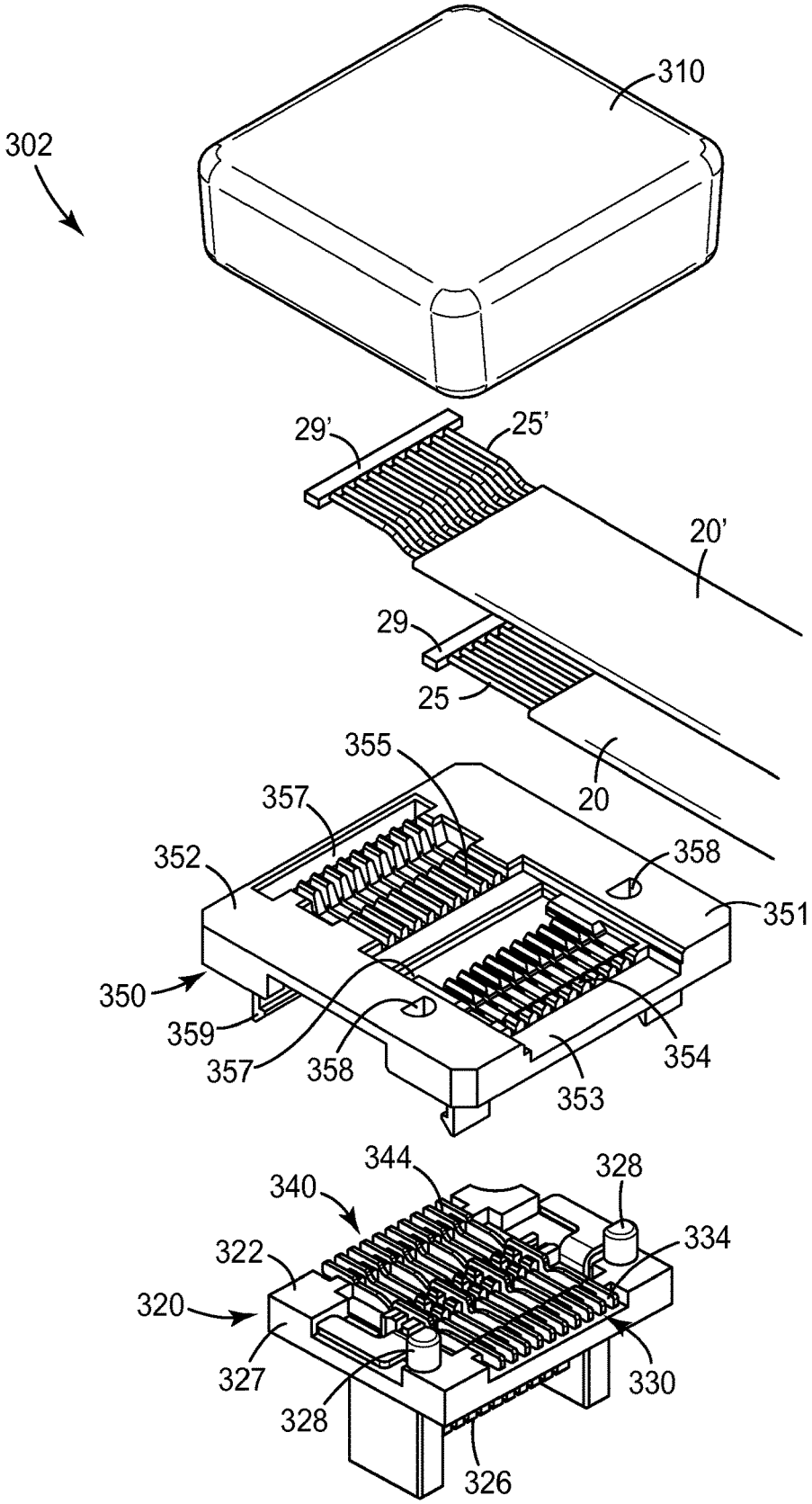
FIG. 9 is an exploded perspective view of a portion of the cable-to-board connector system of FIG. 8.

FIGS. 8 and 9 show another exemplary embodiment of a cable-to-board connector system 300. Cable-to-board connector system 300 includes a plug-style cable connector 302 that mates with a socket-style board mounted connector 400 that is attached to PCB 5. Cable connector 302 includes a plug-style connection base 320 having an insulative housing 322 that holds first contacts 330 and second contacts 340, a cable organizer 350 and a cap 310.

In an exemplary aspect, the insulative housing 322 of connection base 320, the cable organizer 350 and the cap 310 can be formed using an injection molding process with an engineering resin such as a glass filled liquid crystal polymer resin, a polybutylene terephthalate (PBT) resin, a polycarbonate resin, etc.

In an exemplary aspect, the new high speed cable connector can utilize the plug-style connector portion of a board-to board connections such as described in PCT Publication No. WO2011/025640 and PCT Application No. PCT/US2012/046481, herein incorporated by reference in their entirety. Adding the exemplary cable organizer 350 of the present disclosure to a conventional plug-style board-to board connector portion transforms contacts originally adapted to terminate at a conductive trace on a printed circuit board into contacts which can be connected to the wires or conductors of a fine pitch high speed cable.

Connection base 320 can include an insulative housing 322 configured to hold a plurality of first contacts 330 and a plurality of second contacts. Insulative housing 322 includes a housing base 327 and a central wall 326 extending vertically from the base. Central wall 326 has a first side and a second side, each of which can include a plurality of contact channels formed in the central wall.

Housing base 327 can have a plurality of contact channels formed in the outside surface of the housing base. Each contact channel can have a contact opening through the housing base in the bottom of the each contact channel to allow passage of a portion of the first and second contacts to extend through the housing base and into a corresponding contact channels disposed in the first side and the second side of central wall 326.

The first and second contacts 330, 340 can be generally "L" shaped. Each first and second contacts includes a mating portion (not shown) disposed within contact channels formed in the first side and the second side, respectively, of the central wall 326 for making electrical contact with a corresponding contact of a mating connector and a terminal portion 334, 344 disposed in contact channels formed in the outside surface of the housing base 327. The terminal portions 334, 344, which were originally adapted to terminate at a conductive trace on a printed circuit board in a board to board connection system, can be adapted to terminate wires in a cable to the board connection system when cable organizer 350 is placed adjacent to the outside surface of the housing base 327. Thus, in the exemplary cable-to-the-board connector, each of the terminal portions 334, 344 can be used to terminate wires 25, 25' from high speed cables 20, 20'.

Cable organizer 350 is generally analogous to cable organizer 150. Cable organizer 350 can be attached to plug-style connection base 320 to aid in aligning the wires 25, 25' from one or more high speed cables 20, 20' with the contacts 330, 340 disposed in the connection base. Specifically, the connection base 320 can include one or more alignment posts 328 that mate with alignment holes 358 disposed through the cable organizer. In the exemplary aspect shown in the figures the alignment posts 328 and corresponding alignment holes 358 have a D-shape to aid in positioning of the cable organizer on the connection base. However, alternative shapes such as square posts and holes, cylindrical posts and holes, etc. are possible and the shape of the alignment posts and corresponding alignment holes shall not be deemed limiting with respect to the exemplary cable-to-board connector system described herein.

In addition, cable organizer 350 includes an organizer base 352 that can have a plurality of latch arms 359 extending from its lower surface to attach the cable organizer to connection base 320. Latch arms 359 can include a barbed projection that engage connection base 320 to secure the cable organizer to the connection base.

Organizer base 352 of cable organizer 350 includes a central trough 353 formed in the top surface 351 thereof. In one exemplary aspect, central trough 353 can vary in depth from the open end of the central trough to the closed end of the central trough. The organizer base further includes a plurality of first and second grooves 354, 355 disposed within the central trough for positioning wires so that they will be aligned with the first and second contacts 330, 340, respectively. Each of the first and second grooves can have an opening through the organizer base to allow access to the terminal portions 334, 344 of the first and second contacts through the organizer base. In the exemplary embodiment shown in FIG. 9, the pitch of the wires disposed in the cable organizer 350 is approximately the same as the pitch between adjacent contacts disposed in the connection base 320.

Cable organizer 350 can include nesting section 357 disposed adjacent to each of the first and second grooves 354, 355 to accept a terminal anchor 29, 29' disposed on the terminal end of the plurality of wires 25, 25' of exemplary high speed cable 20, 20. The terminal anchors 29, 29' anchor and provide strain relief of the exemplary cable(s) terminated in the exemplary cable connector 302.

The high speed cable(s) 20, 20' can be prepared and terminated to exemplary cable connector 302 in a manner analogous to that described above with respect to the cable preparation and termination to cable connector 302.

As described herein, the current invention provides a means of terminating fine pitch flat ribbon cables directly to the solder tail of a conventional board-to-board style connector portion. In addition, the exemplary cable organizer disclosed herein can help to reduce the overall manufacturing cost by allowing the simultaneous placement and termination of wires with the contacts in the exemplary connector assembly by simplifying and increasing the speed of the soldering process. In addition, the use of a hot bar soldering process improves consistency, quality and uniformity of soldered connections in the exemplary cable connector.

The following are a list of items of the present disclosure:

Item 1 is a connector assembly comprising:

an insulative housing;

a plurality of first contacts disposed in the housing, each first contact comprising:

a first mating portion for making electrical contact with a corresponding contact of a mating connector; and a first terminal portion extending along a housing bottom and adapted to terminate at a conductive trace on a printed circuit board; and a first cable comprising a plurality of first wires, each first wire corresponding to and being terminated at a different first terminal portion.

Item 2 is the connector assembly of item 1 further comprising a cable organizer disposed on the housing bottom and comprising a plurality of first grooves extending along a same first direction and a plurality of first openings, each first opening corresponding to and being in line with a different first groove, each first wire corresponding to and being placed in a different first groove, the first wire being terminated at the first terminal portion corresponding to the first wire through the first opening corresponding to the first groove.

Item 3 is the connector assembly of item 2, wherein the first cable further comprises a terminal anchor formed over a portion of each first wire, the terminal anchor being placed in a first nesting section of the cable organizer extending in a direction perpendicular to the plurality of wires in the cable.

Item 4 is the connector assembly of item 2 further comprising a shielding plate positioned over the central trough in the cable organizer.

Item 5 is the connector assembly of item 2 further comprising a cap disposed over a portion of the insulative housing and the cable organizer.

Item 6 is the connector assembly of item 2 wherein the cable organizer further comprises a plurality of second grooves extending along the first direction and a plurality of second openings, each second opening corresponding to and being in line with a different second groove, each second wire corresponding to and being placed in a different second groove, the second wire being terminated at the second terminal portion corresponding to the second wire through the second opening corresponding to the second groove.

Item 7 is a connector assembly comprising:

an insulative housing;

a plurality of first contacts disposed in the housing, each first contact comprising:

a first mating portion for making electrical contact with a corresponding contact of a mating connector; and a first terminal portion extending along a housing bottom from the first mating portion toward a first side of the housing and adapted to terminate at a conductive trace on a printed circuit board;

a plurality of second contacts disposed in the housing, each second contact comprising:

a second mating portion for making electrical contact with a corresponding contact of a mating connector; and a second terminal portion extending along the housing bottom from the second mating portion toward a second side of the housing, the second side being opposite to the first side, the second mating portion being adapted to terminate at a conductive trace on a printed circuit board;

a plurality of first wires, each first wire corresponding to and being terminated at a different first terminal portion; and a plurality of second wires, each second wire corresponding to and being terminated at a different second terminal portion.

Item 8 is the connector assembly of item 7 further comprising a cable organizer disposed on the housing bottom and comprising:

a plurality of first grooves extending along a same first direction and a plurality of first openings, each first opening corresponding to and being in line with a different first groove, each first wire corresponding to and being placed in a different first groove, the first wire being terminated at the first terminal portion corresponding to the first wire through the first opening corresponding to the first groove; and a plurality of second grooves extending along the first direction and a plurality of second openings, each second opening corresponding to and being in line with a different second groove, each second wire corresponding to and being placed in a different second groove, the second wire being terminated at the second terminal portion corresponding to the second wire through the second opening corresponding to the second groove.

Item 9 is the connector assembly of item 8, wherein the first grooves generally lie in a same first plane and the second grooves generally lie in a second plane offset relative to the first plane.

Item 10 is the connector assembly of item 8, wherein the first grooves and the second grooves in the cable organizer are aligned with one another.

Item 11 is the connector assembly of item 8, wherein the first grooves and the second grooves in the cable organizer can have a staggered arrangement.

Item 12 is the connector assembly of item 8, wherein the first and second openings generally lie in a same plane.

Item 13 is the connector assembly of item 7, wherein the plurality of first wires is contained within a first cable and the plurality of second wires is contained in a second cable.

Item 14 is the connector assembly of item 7, wherein the plurality of first wires and the plurality of second wires are contained within a first cable.

Item 15 is a cable organizer for a connector assembly comprising:

an organizer base having a central trough, wherein the central trough has a first floor section disposed at a first depth, a second floor section disposed at a second depth and sidewalls extending from the first and second floor sections;

a plurality of first grooves extending along the first floor section and parallel to the sidewalls of the central trough, wherein the first grooves aid in the positioning of a plurality of first wires; and a plurality of first openings, each first opening corresponding to and being aligned with a different first groove to allow termination of each first wire with a first terminal portion of a first contact in the connector assembly.

Item 16 is a cable organizer of item 15, further comprising a plurality of second grooves extending along the second floor section wherein each of the second groves includes a second openings dispose in and aligned with each of the second grooves, wherein the second grooves aid in the positioning of a plurality of second wires in the cable organizer and each second opening allows termination of each second wire with a second terminal portion of a second contact in the connector assembly.

Item 17 is the connector assembly of item 16, wherein the first grooves generally lie in a same first plane and the second grooves generally lie in a second plane offset relative to the first plane.

Item 18 is the connector assembly of item 16, wherein the first grooves and the second grooves in the cable organizer are aligned with one another.

Item 19 is the connector assembly of item 16, wherein the first grooves and the second grooves in the cable organizer can have a staggered arrangement Item 20 is the connector assembly of item 16, wherein the first and second openings generally lie in a same plane.

Item 21 is a cable connector comprising:

an insulative housing;

a plurality of first contacts disposed in the housing, each first contact comprising:

a first mating portion for making electrical contact with a corresponding contact of a mating connector; and a first terminal portion extending along a housing bottom and adapted to terminate at a conductive trace on a printed circuit board; and a cable organizer disposed on the housing bottom and comprising a plurality of first grooves extending along a same first direction and a plurality of first openings, each first opening corresponding to and being in line with a different first groove to access the terminal portions of the plurality of first contacts for connecting wires disposed in each first groove therewith.

Item 22 is the cable connector of item 2 wherein the cable organizer further comprises a plurality of second grooves extending along the first direction and a plurality of second openings, each second opening corresponding to and being in line with a different second groove to access terminal portions of a plurality of second contacts for connecting additional wires disposed in each second groove therewith.

Item 23 is the connector assembly of item 22, wherein the first grooves generally lie in a same first plane and the second grooves generally lie in a second plane offset relative to the first plane.

Item 24 is the connector assembly of item 22, wherein the first grooves and the second grooves in the cable organizer are aligned with one another.

Item 25 is the connector assembly of item 22, wherein the first grooves and the second grooves in the cable organizer can have a staggered arrangement.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A connector assembly comprising:

an insulative housing comprising a central recess;

a plurality of first contacts disposed in the housing, each first contact comprising:

a first mating portion for making electrical contact with a corresponding contact of a mating connector inserted in the central recess, the first mating portion being disposed on a lateral side of the central recess; and a first terminal portion extending along a housing bottom and adapted to physically and electrically terminate at a conductive trace on a printed circuit board; and a first cable comprising a plurality of first wires, each first wire corresponding to and being terminated at a different first terminal portion.

2. The connector assembly of claim 1 further comprising a cable organizer disposed on the housing bottom and comprising a plurality of first grooves extending along a same first direction and a plurality of first openings, each first opening corresponding to and being in line with a different first groove, each first wire corresponding to and being placed in a different first groove, the first wire being terminated at the first terminal portion corresponding to the first wire through the first opening corresponding to the first groove.

3. The connector assembly of claim 2, wherein the first cable further comprises a terminal anchor formed over a portion of each first wire, the terminal anchor being placed in a first nesting section of the cable organizer extending in a direction perpendicular to the plurality of wires in the cable.

4. The connector assembly of claim 2 further comprising a shielding plate positioned over the central trough in the cable organizer.

5. The connector assembly of claim 2 further comprising a cap disposed over a portion of the insulative housing and the cable organizer.

6. The connector assembly of claim 2 wherein the cable organizer further comprises a plurality of second grooves extending along the first direction and a plurality of second openings, each second opening corresponding to and being in line with a different second groove, each second wire corresponding to and being placed in a different second groove, the second wire being terminated at the second terminal portion corresponding to the second wire through the second opening corresponding to the second groove.

7. A connector assembly comprising:

an insulative housing comprising a central recess;

a plurality of first contacts disposed in the housing, each first contact comprising:

a first mating portion for making electrical contact with a corresponding contact of a mating connector inserted in the central recess; and a first terminal portion extending along a housing bottom from the first mating portion toward a first side of the housing and adapted to physically and electrically terminate at a conductive trace on a printed circuit board;

a plurality of second contacts disposed in the housing, each second contact comprising:

a second mating portion for making electrical contact with a corresponding contact of a mating connector inserted in the central recess, the first mating portion and the second mating portion being disposed on opposed lateral sides of the central recess; and a second terminal portion extending along the housing bottom from the second mating portion toward a second side of the housing, the second side being opposite to the first side, the second mating portion being adapted to physically and electrically terminate at a conductive trace on a printed circuit board;

a plurality of first wires, each first wire corresponding to and being terminated at a different first terminal portion; and a plurality of second wires, each second wire corresponding to and being terminated at a different second terminal portion.

8. The connector assembly of claim 7 further comprising a cable organizer disposed on the housing bottom and comprising:

a plurality of first grooves extending along a same first direction and a plurality of first openings, each first opening corresponding to and being in line with a different first groove, each first wire corresponding to and being placed in a different first groove, the first wire being terminated at the first terminal portion corresponding to the first wire through the first opening corresponding to the first groove; and a plurality of second grooves extending along the first direction and a plurality of second openings, each second opening corresponding to and being in line with a different second groove, each second wire corresponding to and being placed in a different second groove, the second wire being terminated at the second terminal portion corresponding to the second wire through the second opening corresponding to the second groove.

9. The connector assembly of claim 8, wherein the first grooves generally lie in a same first plane and the second grooves generally lie in a second plane offset relative to the first plane.

10. The connector assembly of claim 8, wherein the first grooves and the second grooves in the cable organizer are aligned with one another.

11. The connector assembly of claim 8, wherein the first grooves and the second grooves in the cable organizer can have a staggered arrangement.

12. The connector assembly of claim 8, wherein the first and second openings generally lie in a same plane.

13. The connector assembly of claim 7, wherein the plurality of first wires is contained within a first cable and the plurality of second wires is contained in a second cable.

14. The connector assembly of claim 7, wherein the plurality of first wires and the plurality of second wires are contained within a first cable.

* * * * *